US005434608A

United States Patent [19]

Sugahara et al.

[11] Patent Number: 5,434,608

[45] Date of Patent: Jul. 18, 1995

[54] DROPLET EJECTING DEVICE

[75] Inventors: Hiroto Sugahara, Ama; Masahiko Suzuki, Nagoya; Yoshikazu Takahashi, Kasugai; Takahiro Kanegae, Nagoya, all of Japan

[73] Assignee: Brother Kogyo Kabushiki Kaisha, Nagoya, Japan

[21] Appl. No.: 947,395

[22] Filed: Sep. 21, 1992

[30] Foreign Application Priority Data

Nov. 6, 1991 [JP] Japan ..... 3-289924

[51] Int. Cl.[6] ..... B41J 2/045

[52] U.S. Cl. ..... 347/71

[58] Field of Search ..... 346/140 R; B41J 2/045; 347/68, 71, 69

[56] References Cited

U.S. PATENT DOCUMENTS

| | | | |
|---|---|---|---|
| 4,032,929 | 6/1977 | Fischbeck et al. | 346/140 R |
| 4,383,264 | 5/1983 | Lewis | 346/140 R |
| 4,450,375 | 5/1984 | Siegal . | |
| 4,520,374 | 5/1985 | Koto | 346/140 R |
| 4,752,788 | 6/1988 | Yasuhara et al. | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,929,256 | 5/1990 | Shepherd . | |
| 4,940,996 | 7/1990 | Paton et al. | 346/140 R |
| 4,942,409 | 7/1990 | Paton et al. | 346/140 R |
| 4,973,981 | 11/1990 | Bartky et al. | 346/1.1 |
| 4,992,808 | 2/1991 | Bartky et al. | 346/140 R |
| 5,003,679 | 4/1991 | Bartky et al. | 29/25.35 |
| 5,028,936 | 7/1991 | Bartky et al. | 346/140 R |
| 5,252,994 | 10/1993 | Narita et al. | 346/140 R |

FOREIGN PATENT DOCUMENTS

| | | | |
|---|---|---|---|
| 0364136A3 | 4/1990 | European Pat. Off. | B41J 2/045 |
| 0402172 | 12/1990 | European Pat. Off. | B41J 2/045 |
| 0416540A2 | 3/1991 | European Pat. Off. | B41J 2/045 |
| 0505188A2 | 9/1992 | European Pat. Off. | B41J 2/045 |
| 56-25464 | 3/1981 | Japan . | |

OTHER PUBLICATIONS

IBM Technical Disclosure Bulletin, Piezoelectric Driver for Drop-On-Demand Ink Jet, vol. 30, No. 2, Jul. 1987, pp. 611 and 612.

Research Disclosure, (2244), Jul. 1987, No. 279, New York, N.Y., p. 434.

JP20 03 311, Jan. 8, 1990, Pat. Abstracts of Japan.

JP57-19 5667, Dec. 1, 1982, Pat. Abstracts of Japan.

JP3-49 957, Mar. 4, 1991, Pat. Abstracts of Japan.

*Primary Examiner*—Benjamin R. Fuller
*Assistant Examiner*—Alrick Bobb
*Attorney, Agent, or Firm*—Oliff & Berridge

[57] ABSTRACT

A droplet ejecting device comprises a piezoelectric transducer consisting of first and second piezoelectric transducers polarized in the directions opposite to each other, the first and second piezoelectric transducers bonded to each other and having electrodes disposed at the inner and outer surfaces thereof. A member is fitted to the piezoelectric transducer to define ink chambers, the member having an orifice associated with each ink chamber. An injection controller applies an electric field to the electrode(s) associated with the predetermined ink chamber(s) so as to eject an ink droplet(s) from the ink chamber(s) through the orifice(s) in a given position. As a result, the invention provides a droplet ejecting device where an ink ejecting cycle of the array as a whole is short, the print speed is high, and electrodes can be easily manufactured.

14 Claims, 5 Drawing Sheets

DROPLET EJECTING DEVICE

BACKGROUND OF THE INVENTION

1. Field of the Invention

The invention relates to a droplet ejecting device and, more particularly, to a droplet ejecting device which uses deformation of a piezoelectric transducer.

2. Description of Related Art

A piezoelectric ink jet type printer head has been conventionally proposed, wherein the volume of an ink passage is changed using the deformation of a piezoelectric transducer. Ink staying in the ink passage is ejected through an orifice at the time of a decrease in volume while ink is introduced into the ink passage, via a valve disposed on a side opposite to the orifice, at the time of an increase in volume. This type of ink jet printer head is called a drop-on-demand type. A plurality of ejectors, each structured as described are arranged adjacent to one another. The ink is ejected from the ejector(s) located in a predetermined position(s) so that a desired character or image is formed.

This type of droplet ejecting device is disclosed in, for example, U.S. Pat. Nos. 4,992,808; 5,003,679; 5,028,936. FIGS. 4 and 5 schematically show one of conventional droplet injecting devices. This conventional device will be explained in detail hereinafter referring to FIG. 4, which is a cross sectional view showing a part of an array of the conventional droplet ejecting device. A piezoelectric ceramic plate (piezoelectric transducer) 1, which has a plurality of side walls 2A, 2B, 2C and 2D and is polarized in the direction indicated by an arrow 51, is bonded to a cover plate 21 made of a metal, glass or ceramic material via a bonding layer 12. The walls 2A, 2B, 2C, 2D and the outside walls define ink passages 31A, 31B and 31C. Each ink passage 31 is formed into an elongated shape of a rectangular cross section. The side walls 2 extend along the entire length of the ink passage, and can be deformed in the vertical direction with respect to an axis of the ink passage and the polarizing direction. A metal electrode 11 for applying a driving electric field is formed on the side wall 2.

In the array, if the ink passage 31B is selected on the basis of a predetermined print data, a driving electric field is applied between the metal electrodes 11C and 11D, and between the metal electrodes 11E and 11F, respectively. Since the direction of the driving electric field is perpendicular to the polarizing direction, the side walls 2B and 2C are deformed inward of the ink passage 31B by a piezoelectric thickness shear effect. With this deformation, the volume of the ink passage 31B is decreased so that the ink pressure is increased. Accordingly, an ink droplet is ejected through an orifice 42 (see FIG. 5). When application of the drive electric field is stopped, the side walls return to their original positions, before the deformation, so that the ink pressure in the passage is decreased. Consequently, ink is supplied into the passage from an ink supplying portion (not shown).

The array is manufactured by the following method. As shown in FIG. 5, parallel grooves 3, constituting the ink passages having the above-mentioned shape, are formed in the piezoelectric ceramic plate 1, polarized in the direction indicated by the arrow 51, by grinding using a diamond cutting disk. On the sides of the groove 3, the aforementioned metal electrode is formed by spattering or the like. The cover plate 21 is bonded to the upper grooved surface 4A of the piezoelectric ceramic plate 1. An orifice plate 41 is bonded to the end surface 4B, on the ink ejecting side of the piezoelectric ceramic plate 1. The orifice plate 41 is provided with orifices 42 formed to correspond to the face of the ink passages.

In the above described conventional droplet ejecting device, the side walls of the piezoelectric ceramics are deformed inward of the ink passages by the piezoelectric thickness shear effect.

However, because the side walls of the piezoelectric ceramics are interposed between the adjacent ink passages, it is impossible to simultaneously eject ink droplets from the adjacent ink passages. Consequently, the array of the droplet ejecting device is divided into a plurality of groups for ejection control. Therefore, an ink ejecting cycle of the array as a whole in the droplet ejecting device is longer than that in the case where the ink droplets can be simultaneously ejected from the adjacent ink passages, with an attendant problem of a low print speed.

Furthermore, in the conventional droplet ejecting device described above, the metal electrode is disposed on the side walls, i.e., only on the inner surfaces of the groove. The metal electrode is disposed on the side walls and on the upper surface of the side wall by spattering or the like, and then, the metal electrode material disposed on the upper surface of the side wall must be removed. As a result, manufacturing of the metal electrode is complicated and difficult.

SUMMARY OF THE INVENTION

The invention has been accomplished to solve the above problems. An object of the invention is to provide a droplet ejecting device where an ink ejecting cycle of the array as a whole in the droplet ejecting device is short, a print speed is high, and the electrode can be easily manufactured.

In order to achieve the above object, the droplet ejecting device according to the invention comprises a piezoelectric transducer consisting of first and second piezoelectric transducers polarized in the directions opposite to each other and bonded to one another with electrodes disposed at the surface thereof, respectively; a member fitted to the piezoelectric transducer to constitute ink chambers; orifices; and ejection control means for applying an electric field to the electrode located in a predetermined position so as to eject an ink droplet from the ink chamber through the orifice in a given position.

In the droplet ejecting device having the above structure according to the invention, the injection control means applies an electric field to the electrode located in the predetermined position so that the first and second piezoelectric transducers polarized in the directions opposite to each other are deformed by the piezoelectric thickness shear effect with application of the electric field. Consequently, the ink pressure in the ink chamber is increased and the ink droplet can be ejected from the ink chamber through the orifice.

DETAILED DESCRIPTION OF THE PREFERRED EMBODIMENT

A droplet ejecting device embodying the invention will be described hereinafter with reference to the accompanying drawings.

Figure 1:
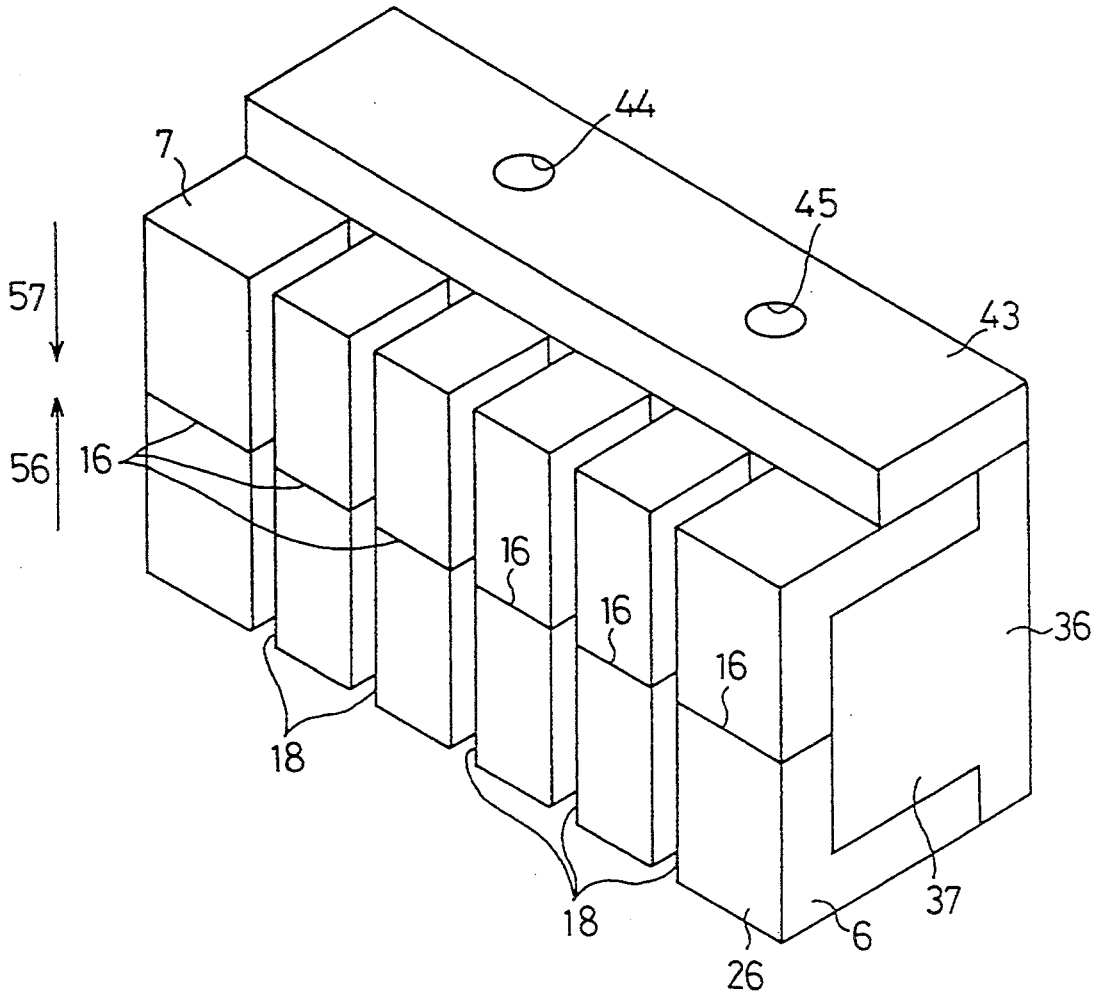
FIG. 1 is a oblique view of the array of a droplet ejecting device in a preferred embodiment of the invention.
Figure 2:
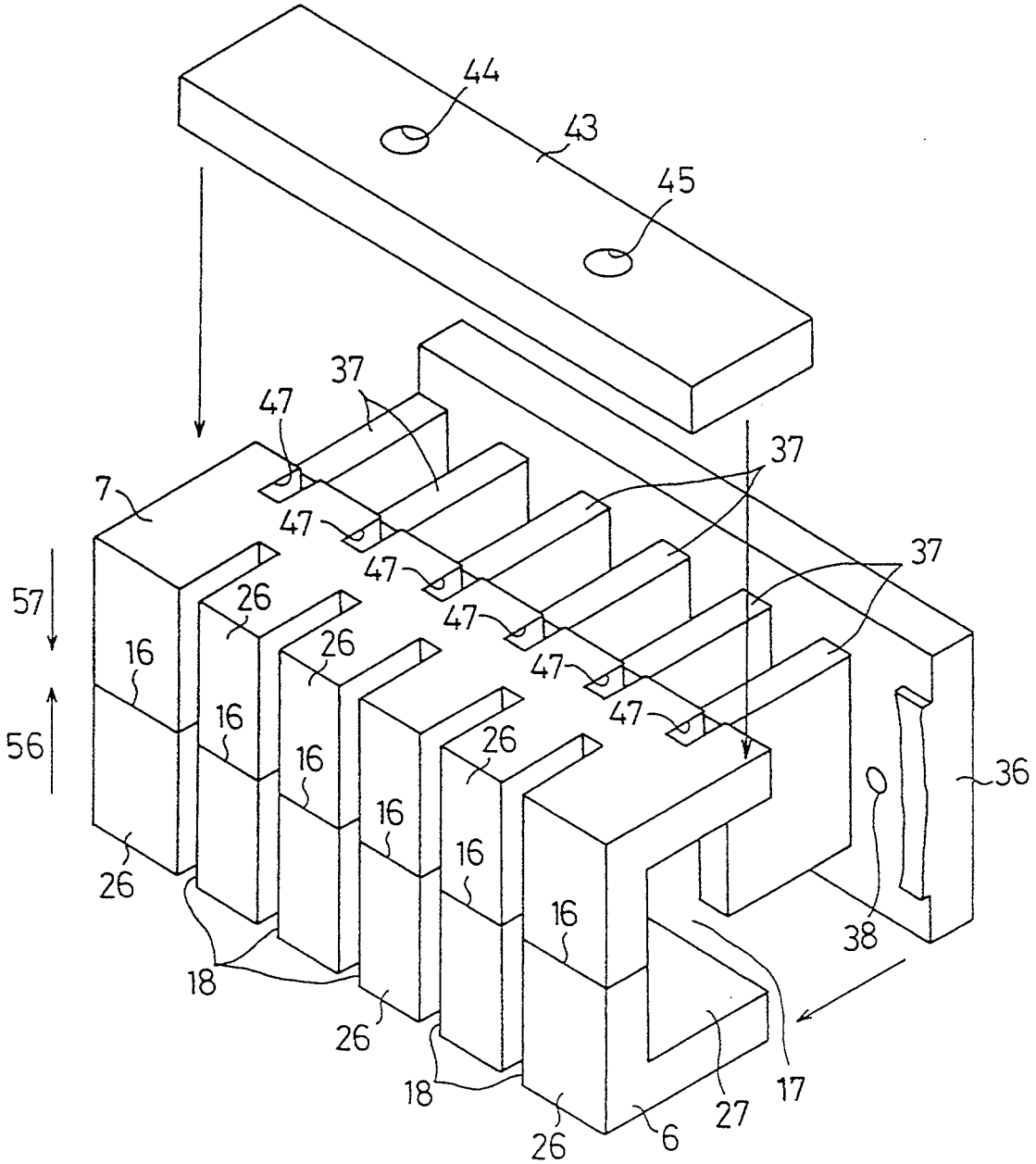
FIG. 2 is a perspective view showing the structure of the array of the droplet ejecting device in the preferred embodiment according to the invention.
Figure 2A:
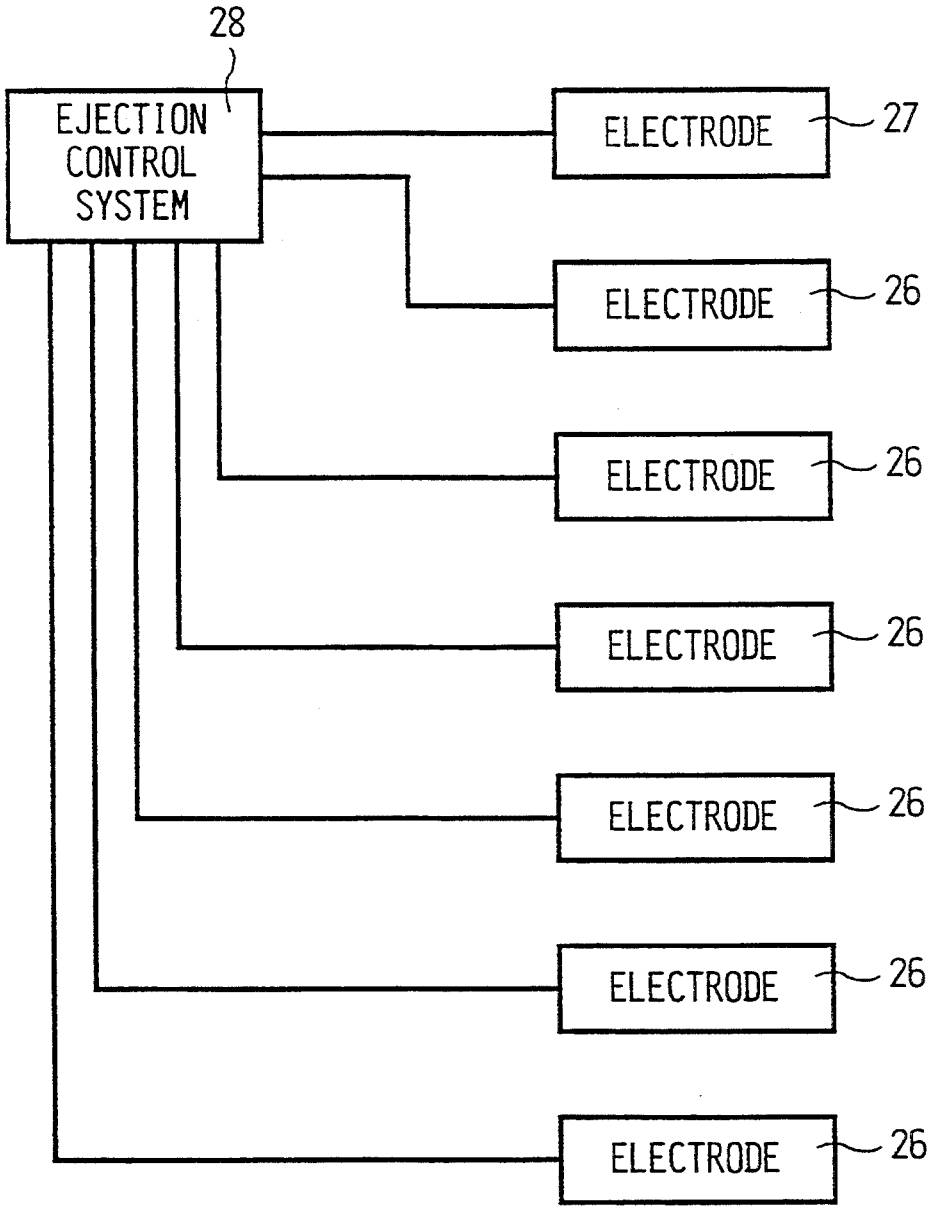
FIG. 2A is a block diagram of the ejection control system.

The structure will be described with reference to FIGS. 1 and 2 with FIG. 2 being a perspective view of an array of the droplet ejecting apparatus of the preferred embodiment according to the invention. A first piezoelectric ceramic block (piezoelectric transducer) 6 is polarized in the direction indicated by an arrow 56. Additionally, a second piezoelectric ceramic block (piezoelectric transducer) 7 is polarized in the direction indicated by an arrow 57. The first piezoelectric block 6 and the second piezoelectric block 7 are bonded to each other via a bonding layer 16. A groove 17 constituting a part of the ink chambers is defined by an inner surface of the first and second piezoelectric blocks 6, 7, while slits 18 for dividing the piezoelectric blocks 6, 7 into the ink chambers are formed at the outer surface of each of the piezoelectric blocks 6,7. Moreover, a metal electrode 26, for applying a driving electric field, is formed over the outer surface, that is the slit 18 side except for in the slits 18; and another metal electrode 27, for applying a driving electric field, is formed over the inner surface, that is the groove 17 side, of the piezoelectric blocks 6,7 by spattering or the like. The slits 18 are formed after assembly of the piezoelectric blocks 6,7 and the application of electrodes 26, 27.

A member 36 for completing the ink chambers is made of a soft material such as a resin material and is provided at one surface thereof with side walls 37 facing to the slits 18. An orifice 38 is formed, in a middle position between the adjacent side walls 37, facing to the ink chamber.

The array consisting of the first and second piezoelectric ceramic blocks 6, 7 is fitted to the member 36 to define the ink chambers with the side walls 37 and the orifices 38 centered in the ink chambers. This fitting is carried out by bonding with an adhesive, by pressing together in a tight fit or a similar manner such that the assembled piezoelectric blocks 6,7 and the member 36 define a plurality of ink chambers.

An ink supply chamber 43 is mounted to an upper surface of the array consisting of the first and second piezoelectric ceramic blocks 6,7 and member 36. Inlet 44 and outlet 45 are connected to an ink reservoir (not shown). Ink supplied from the ink reservoir enters ink supplying path 5, via inlet 44 found in ink supplying chamber 43, and is then fed downwardly through openings 47, formed in an upper front portion of piezoelectric block 7, into the ink chambers. Outlet 45 is provided to permit circulation of the ink. Openings 47 are midway between sidewalls 37 defining each ink chamber.

Figure 3A:
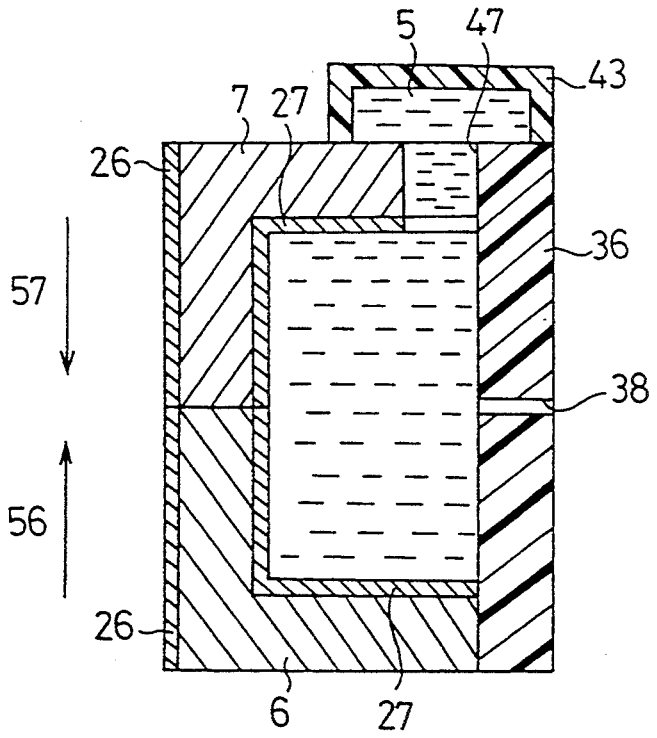
FIGS. 3A and 3B are cross sectional views showing one of the ejectors in the array of the droplet injecting device, in the preferred embodiment according to the invention, with FIG. 3A showing the ejector in its normal state and FIG. 3B showing the ejector during ejection.
Figure 3B:
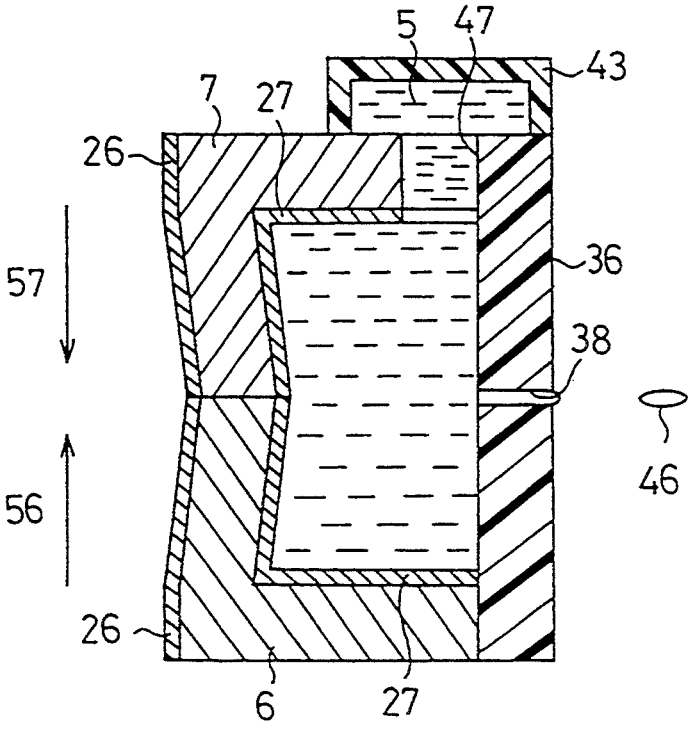
Figure 4:
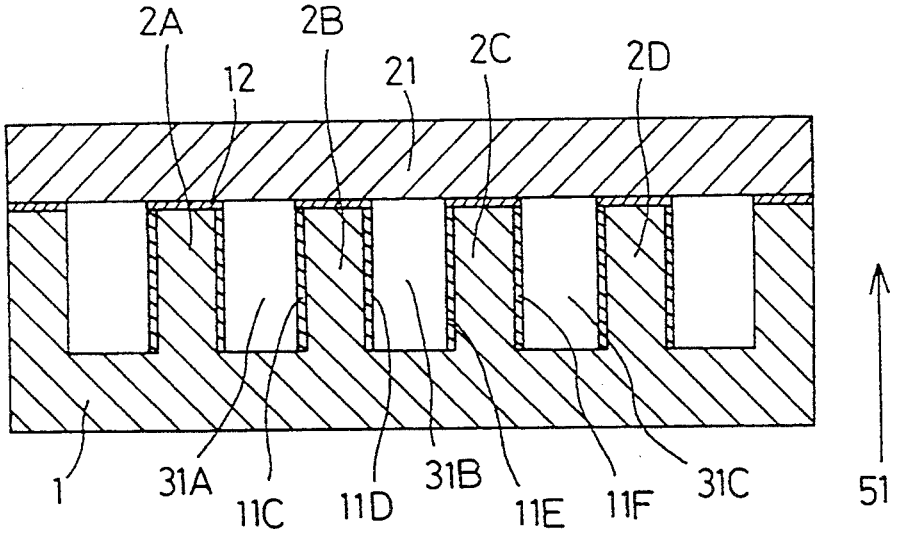
FIG.4 RELATED ART
FIG. 4 is a cross sectional view showing a part of an array of a conventional droplet ejecting device.
Figure 5:
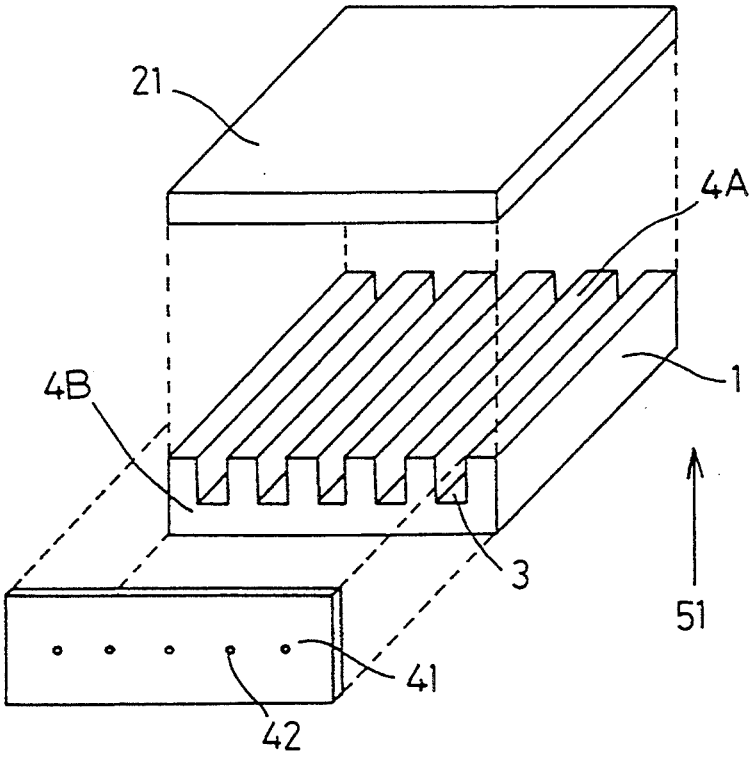
FIG.5 RELATED ART
FIG. 5 is a perspective view showing the structure of the array of the conventional droplet ejecting device.

Operation of the droplet ejecting device in the preferred embodiment will be described with reference to FIGS. 3A and 3B, which are cross sectional views showing one of ejectors in the array of the droplet ejecting device. When one ejector is selected on the basis of a predetermined print data, a driving electric field is applied, by an ejection control system 28 in a known manner, between the metal electrodes 26,27 of the first and second piezoelectric blocks 6,7. Since the direction of the driving electric field is perpendicular to the polarizing direction, the first and second piezoelectric blocks 6,7 are deformed inward into the groove 17 constituting a part of the ink chamber by a piezoelectric thickness shear effect. This deformation causes the volume of the groove 17 to be decreased while the pressure of ink inside the ink chamber is increased. As a result, an ink droplet 46 is ejected through the orifice 38. Upon stopping the application of the driving electric field, the first and second piezoelectric ceramic blocks 6,7 return to their original positions and the ink pressure inside the groove 17 is decreased. As a result, ink is supplied from an ink supplying passage 5 through an opening 47.

In the conventional droplet ejecting device, the side walls of the piezoelectric ceramics, which are deformed by the application of a driving voltage, are positioned between the ink passages so that it is impossible to simultaneously eject the ink droplets from adjacent ink passages. Consequently, the array of the droplet ejecting device is divided into a plurality of groups for ejection control. Therefore, the ink ejecting cycle of the array as a whole in the droplet ejecting device is longer than that in the case where the ink droplets can be simultaneously ejected from the adjacent ink passages with an attendant problem of a low print speed.

However, in the droplet ejecting device of this embodiment, the piezoelectric ceramic blocks 6,7 which are deformed by the application of the driving voltage are not interposed between adjacent ink chambers but are disposed in the lateral direction, that is, they form an end wall of the adjacent ink chambers and, accordingly, the ink droplets can be simultaneously ejected from adjacent ink passages. Therefore, the ink ejecting cycle of the array as a whole in the droplet ejecting device is short resulting in a high print speed.

Furthermore, in the conventional droplet ejecting device, the metal electrode is disposed on the surface of each side wall, i.e., only at the side surfaces of the grooves. The conventional device is therefore accompanied by the problems that when the metal electrodes are formed on the surface they are also formed on the upper surface of the side wall by the spattering or other method and the metal electrode formed at the upper surface of the side wall must be removed. As a result, the manufacturing process of the metal electrode is complicated and difficult.

However, in the droplet injecting device according to the present invention, the first and second piezoelectric ceramic blocks 6,7 are bonded, such as by an adhesive, to each other and the groove 17 constituting a part of the ink chamber is formed before the metal electrode 27 is disposed over the whole inner surface of the groove 17 and the metal electrode 26 is disposed over the rear outer surface by spattering or the like. Then, the metal electrodes 26 can be separated by simply forming the slits 18. As a result, the metal electrode 26 is divided into parts for each of the droplet ejectors and the metal electrode 27 is common for all of the droplet ejectors. Therefore, in the droplet ejecting device according to the invention, the manufacture of the metal electrode is remarkably facilitated.

To manufacture the droplet injecting device, the first and second piezoelectric ceramic blocks are formed to have an L-shaped cross section. The two piezoelectric ceramic blocks 6,7 are then bonded at the ends of their base legs by means of an adhesive to form a base block having a U-shaped cross section. Alternatively, solid blocks may be bonded together and then a grove 17 cut therein centered on the bond. As a result, the L-shaped piezoelectric ceramic blocks 6,7 bonded at one end are formed and produce the U-shaped base block. The inner surface of the base block, which defines a groove 17, is coated with the metal electrode 27 by spraying, spattering or other known application methods and the metal electrode 26 is coated on the base outer surface in a similar manner. Slits 18 are then cut into the base part of the base block to divide the metal electrode 26 into separate electrodes for each of the ink droplet ejectors. In addition, openings 47 are cut into the end of piezoelectric ceramic block 7 opposite that end bonded to piezoelectric ceramic block 6. (Alternatively, openings 47 could be found in piezoelectric ceramic block 7 when it is formed.) Member 36 is then bonded to the base block using an adhesive or, alternatively, by tight fitting within the groove 17 of the base block in order to define the plurality of ink chambers. Lastly, ink supplying chamber 43 is bonded to the base block and an edge of the member 36 so as to overlay and be connected with openings 47.

It is to be understood that the invention is not restricted to the embodiment described above. Various modifications and alterations can be added thereto without departing from the scope of the invention. For example, the first and second piezoelectric ceramic blocks 6,7 may be reversely polarized to the directions indicated by the arrows 56 and 57.

In addition, the applying direction of the electric field in ejecting the ink droplet and supplying the ink may be the reverse to the aforementioned direction. Namely, the first and second piezoelectric ceramic blocks may be deformed by the application of the driving voltage outward of the groove 17 constituting a part of the ink chamber by the piezoelectric thickness shear effect. This deformation allows a volume of the groove 17 to be increased while the pressure of the ink inside the ink chamber is decreased thus supplying the ink from the ink supplying passage 5 through opening 47. Further, upon stopping the application of the driving electric field, the rear wall returns to the original position before the deformation so that the ink pressure inside the groove 17 is increased and the ink droplet 46 is ejected through the orifice 38.

In the droplet ejecting device according to the invention, as is apparent from the above description, the piezoelectric transducers which are deformed by the application of the driving voltage are not interposed between the adjacent ink chambers but disposed in the lateral direction of the adjacent ink chambers. Consequently, the ink droplets can be simultaneously ejected from adjacent ink passages and the ink ejecting cycle of the array as a whole is short so that a print speed becomes high. Additionally, the metal electrodes can be easily formed.

What is claimed is:

1. A droplet ejecting device having a plurality of ejectors in which a volume of an ink chamber of each of the plurality of ejectors is changed by use of a piezoelectric transducer so as to eject ink from the ink chamber, said droplet ejecting device comprising:

a piezoelectric transducer consisting of first and second piezoelectric transducers polarized in directions opposite to one another, said first and second piezoelectric transducers bonded to one another and said piezoelectric transducer has a first electrode disposed on a first surface and a plurality of electrodes disposed on a second surface;

a member mounted to said piezoelectric transducer to face said first surface to define the ink chambers of each of the plurality of ejectors between said first surface and said member;

a plurality of orifices provided in said member, each of said plurality of orifices exclusively communicating with an associated ink chamber of each of the plurality of ejectors; and ejection control means for applying an electric field between at least one of the plurality of electrodes and the first electrode so as to eject an ink droplet from the ink chamber of each of the plurality of ejectors subjected to the electric field through said orifice in at least one given position, wherein the electric field is perpendicular to the directions of polarization of said first and second piezoelectric transducers.

2. The droplet ejecting device as claimed in claim 1, wherein the bonded first and second piezoelectric transducers each have a L-shape cross-section including a base leg and a long leg, the first and second piezoelectric transducers are bonded at an end of the base leg of each of said first and second piezoelectric transducers to define a groove between the long leg of each of said first and second piezoelectric transducers, said groove having a base where said first and second piezoelectric transducers are bonded.

3. The droplet ejecting device as claimed in claim 2, wherein the bonded first and second piezoelectric transducers define a block U-shaped channel having the base where said first and second piezoelectric transducers are bonded, said first surface being an inner surface of said block U-shaped channel and said second surface being a surface of said base opposite said block U-shaped channel.

4. The droplet ejecting device as claimed in claim 1, wherein said member comprises:

a front plate; and a plurality of panels extending from a surface of said front plate opposing said first surface of said piezoelectric transducer, said panels engaging said piezoelectric transducer to form said ink chambers, wherein said plurality of orifices are formed in said front plate.

5. The droplet ejecting device as claimed in claim 4, wherein said piezoelectric transducer has a plurality of openings, said openings adjacent where an end of said piezoelectric transducer joins said front plate, each of said plurality of openings connecting an ink supply means to an associated one of said ink chambers.

6. The droplet ejecting device as claimed in claim 4, wherein a plurality of slits are formed in said piezoelectric transducer, said slits opposing said panels extending from said front plate and separating said plurality of second electrodes formed on said second surface.

7. A droplet ejecting device for an ink jet printer, comprising:

a first block having an L-shaped cross-section formed by a base leg and a long leg;

a second block having a L-shaped cross-section formed by a base leg and a long leg, an end of the base leg of said first block and an end of the base leg of said second block are joined to produce a block having a U-shaped cross-section comprising a base and two long legs extending from said base;

a first electrode formed on an inner surface of said base of said U-shaped block;

a plurality of second electrodes formed on an outer surface of said base of said U-shaped block;

a member having a plurality of spaced sidewalls is joined to said long legs of said U-shaped block for defining a plurality of ink chambers therebetween; and ink supplying means for supplying ink to each said ink chamber of said plurality of ink chambers.

8. The droplet ejecting device as claimed in claim 7, wherein said first block and said second block are joined by an adhesive.

9. The droplet ejecting device as claimed in claim 7, wherein said first block and said second block are ceramic blocks.

10. The droplet ejecting device as claimed in claim 7, wherein said member means is joined to said block by one of bonding by an adhesive and by press fitting together with said block in a tight fit.

11. The droplet ejecting device as claimed in claim 10, wherein said member is made of a resin material.

12. The droplet ejecting device as claimed in claim 7, wherein said member comprises:

a front plate;

a plurality of panels extending from a rear surface of said front plate, said panels engaging said block to form said ink chambers; and a plurality of orifices formed in said front plate, an orifice being provided for each of said ink chambers.

13. The droplet ejecting device as claimed in claim 12, wherein said first block has a plurality of openings, said openings adjacent where an end of said long leg of said first block joins said front plate, each of said plurality of openings connecting said ink supply means to an associated one of said plurality of ink chambers.

14. The droplet ejecting device as claimed in claim 7, wherein a plurality of slits are formed in said block, said slits opposing said panels extending from said front plate and separating said plurality of second electrodes formed on said outer surface of said base of said block.

* * * * *